United States Patent [19]

Knap

[11] 4,150,509

[45] Apr. 24, 1979

[54] SLIDING DOORS AND SEALS SYSTEM FOR PASSENGER VEHICLE

[75] Inventor: Joseph Knap, Montreal, Canada

[73] Assignee: Canadair Limited, Montreal, Canada

[21] Appl. No.: 890,316

[22] Filed: Mar. 27, 1978

[30] Foreign Application Priority Data

Jan. 24, 1978 [CA] Canada ..... 295686

[51] Int. Cl.[2] ..... E05F 17/00

[52] U.S. Cl. ..... 49/123; 49/411; 49/477

[58] Field of Search ..... 49/123, 409, 411, 477, 49/478, 484, 118, 360

[56] References Cited

U.S. PATENT DOCUMENTS

| | | | |
|---|---|---|---|
| 3,352,446 | 11/1967 | Anderson et al. | 49/477 X |
| 3,439,454 | 4/1969 | Stretton | 49/123 X |
| 3,694,962 | 10/1972 | McDonald et al. | 49/477 |

*Primary Examiner*—Philip C. Kannan
*Attorney, Agent, or Firm*—A. Lebrun

[57] ABSTRACT

A sliding doors and seals system and a passenger vehicle having such system with the latter including inflatable seals and weather seals arranged to conceal and protect the inflatable seals against direct and even indirect contamination and tampering therewith and such as to provide a failsafe feature whereby a pair of sliding doors will be frictionally retained closed by one inflatable seal alone upon failure of the other inflatable seal. This system comprises a side wall having a door aperture and defining a pair of lateral edge portions extending along the opposite lateral edges of the door aperture, a pair of three-sided inflatable seals cooperatively extending longitudinally along the full periphery of the door aperture and each having a lateral portion secured against the corresponding lateral edge portion of the side wall, a pair of static seals secured against each lateral edge portion on the opposite sides respectively of the corresponding lateral portion of the inflatable seals, one static seal outward of the corresponding inflatable seal forming a static weather seal engaging the internal border of the corresponding sliding door, the lateral edge portions of the side wall and the seals against it remain overlapped or covered by the corresponding sliding door for any position of the doors, the inflatable seals are separately pressurized and the doors are positively interconnected by a cable to provide the above mentioned failsafe feature.

9 Claims, 11 Drawing Figures

SLIDING DOORS AND SEALS SYSTEM FOR PASSENGER VEHICLE

FIELD OF THE INVENTION

This invention relates to seals for sliding doors, and more particularly, to a sliding doors and seals system of the type adapted for a rapid transit passenger car.

The sliding doors of a rapid transit passenger car or of another passenger vehicle are subject to heavy use amounting to many opening and closing cycles. It has so far been proposed to use inflatable air seals to seal sliding doors and wherein the inflation of the seals is adapted to compensate for a relaxed fit between the doors and the associated door frame. Inflatable seals proposed so far are fixed to the sliding doors and are thus inherently subject to wear and tampering therewith. In any case, the inflatable seals which have been proposed so far are not really adapted for the aforementioned contemplated use; for instance, they are uncovered by opening of the doors and thus externally exposed to direct contamination and tampering therewith, they are not adapted to provide a failsafe feature for a pair of sliding doors when one seal fails, and they are not associated to weather seals to provide sealing for a car which is not in operation and to provide protection against even indirect contamination.

SUMMARY OF THE INVENTION

It is a general object of the present invention to provide a sliding doors and seals system of the above type and a passenger vehicle having such system with the latter particularly adapted to avoid the above mentioned disadvantages of the prior art seals.

It is another general object of the present invention to provide a sliding doors and seals system of the above type and a passenger vehicle having seals secured to the fixed structure rather than to the movable doors and concealed at least against direct exposure to contamination and tampering therewith.

It is a further general object of the present invention to provide a sliding doors and seals sywtem of the above type and a passenger vehicle having inflatable seals allowing less stringent tolerance requirements for the doors than with static seals and allowing failsafe locking of a pair of doors through frictional braking engagement by one inflatable seal only and positive intercoupling between these doors upon failure of the other inflatable seal.

It is another object of the present invention to provide a sliding doors and seals system of the above type and a passenger vehicle including inflatable seals which are protected against contamination by static weather seals and so is the internal surface of each door against which a corresponding inflatable seal operatively engages.

It is a more specific object of the present invention to provide a sliding doors and seals system of the above type and a passenger vehicle with lateral seal portions always remaining covered or overlapped by the sliding doors for protection thereof against direct contamination and tampering therewith.

It is a further object of the present invention to provide a sliding doors and seals system of the above type and a passenger vehicle with a combination of inflatable seals for operative sealing against sound and vibration of the doors when the passenger vehicle is in operation, and static weather seals adapted to seal against contamination when the vehicle is not in operation such as when a rapid transit car is parked on a track.

It is still another object of the present invention to provide a sliding doors and seals system of the above type and a passenger vehicle having inflatable seals extending all around the door aperture with a bottom portion concealed under the threshold against undue wear and tear by the passenger traffic.

BRIEF DESCRIPTION OF THE DRAWNGS

The above and other objects and advantages of the present invention will be better understood with reference to the following detailed description of a preferred embodiment thereof which is illustrated, by way of example, in the accompanying drawings; in which.

Figure 1:
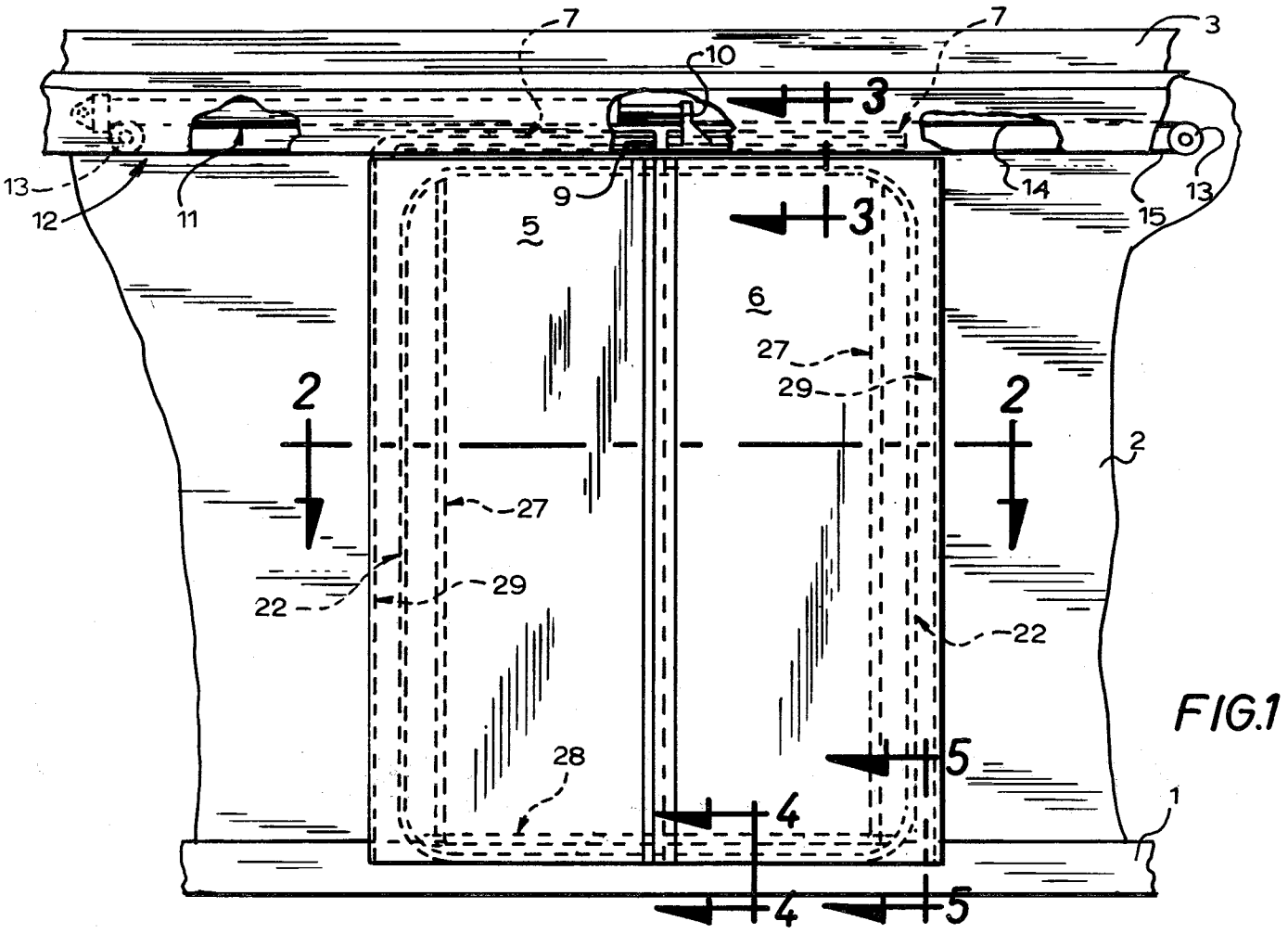
FIG. 1 is a side elevation view of a pair of sliding doors and associated elements on one side of a rapid transit passenger car and embodying a sliding doors and seals system according to the present invention.
Figures 2, 2A, 2B, 2C:
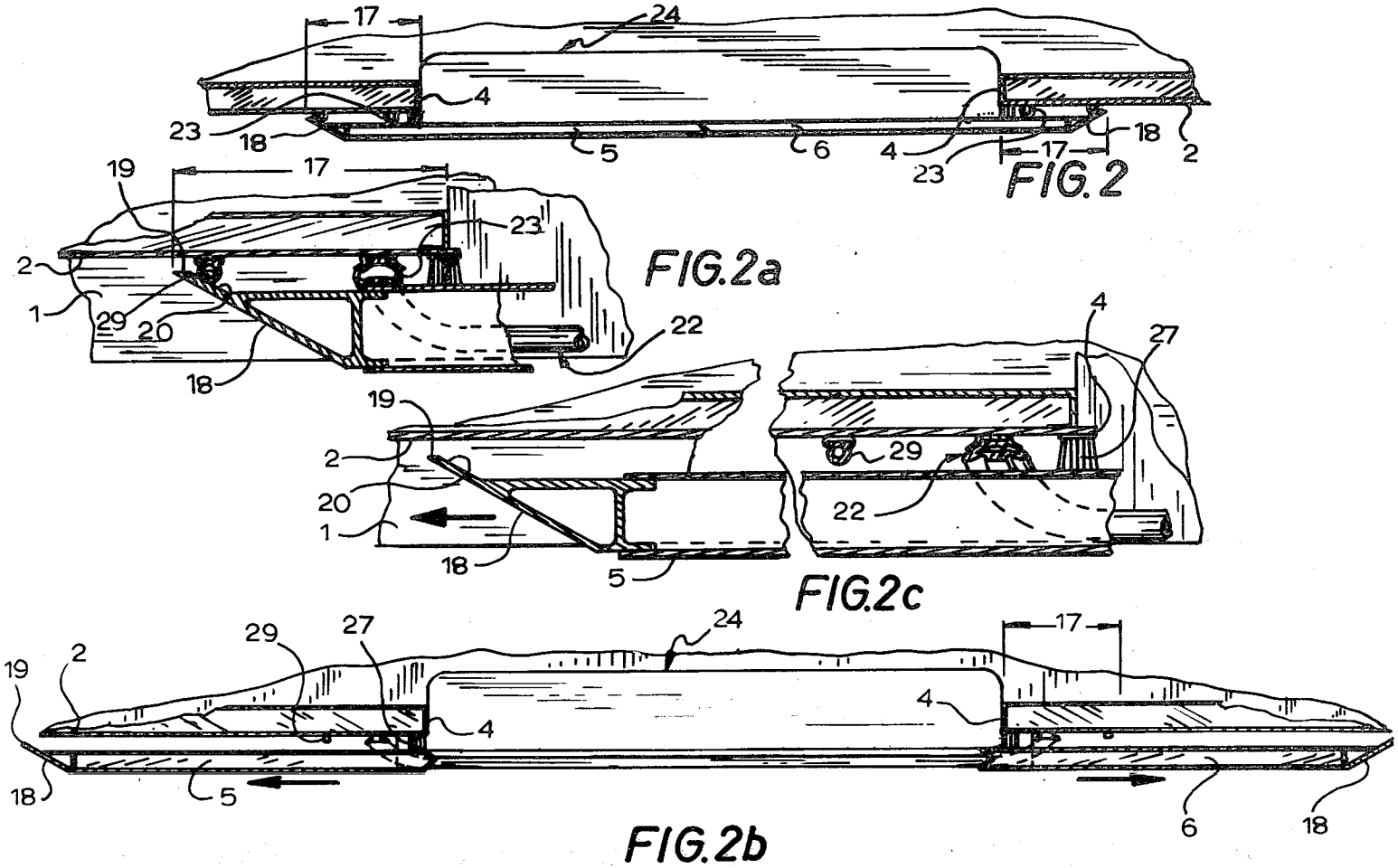
FIG. 2 is a cross-sectional view as seen along line 2—2 in FIG. 1.
Figure 3:
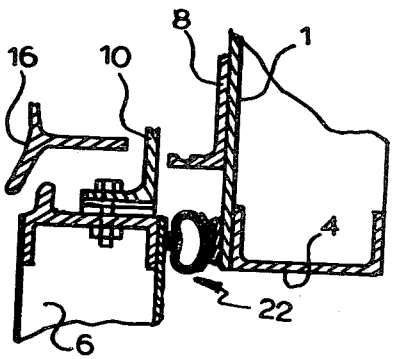
Figure 4:
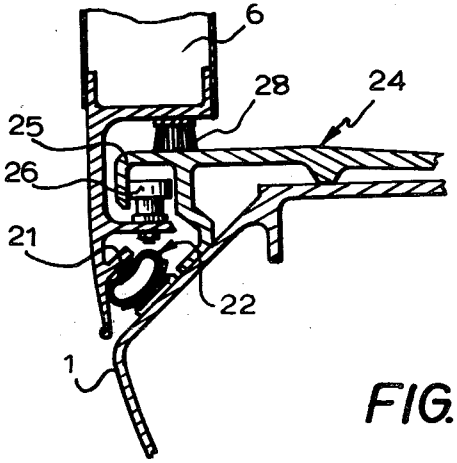
Figure 7:
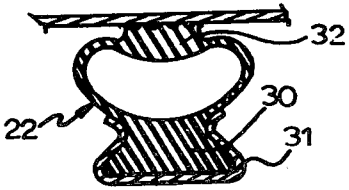
Figure 6:
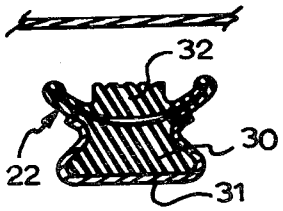
Figure 5:
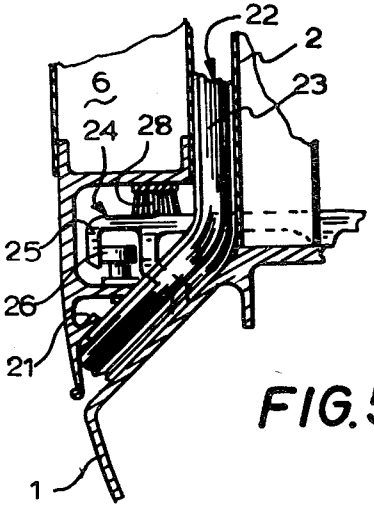
Figure 8:
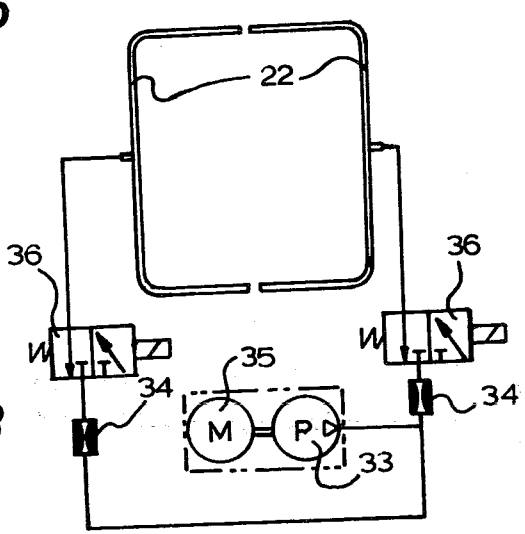

FIG. 2*a* is a cross-sectional and enlarged scale view of the left portion of FIG. 2;

FIGS. 2*b* and 2*c* correspond to FIGS. 2 and 2*a* respectively but with the doors open;

FIGS. 3, 4 and 5 are cross-sectional views as seen along lines 3—3, 4—4 and 5—5 respectively in FIG. 1;

FIGS. 6 and 7 are mere cross-sectional views of the inflatable seal in inoperative and operative sealing positions respectively, and FIG. 8 is a simplified diagram of the air pressure supply circuit to separately pressurize the two inflatable seals.

DESCRIPTION OF THE PREFERRED EMBODIMENT

The illustrated sliding doors and seals system includes a side wall comprising a lateral sill 1 and a metal skin 2. An elongaged cant rail 3 covers the longitudinal junction between the roof framework and the side wall. The side wall is formed with a passageway aperture 4 therethrough. The system according to the present invention also includes a pair of sliding doors 5 and 6 which slide edgewise longitudinally and externally relative to the side wall and to and fro relative to each other.

The sliding doors 5 and 6 are actuated and supported for such displacement thereof by a sliding door closure and hanger system which need not be defined in full details in this case. It suffices to say that the door hanger includes slide track unit 7 of which a stationary slide track member 8 is partly shown in cross-section in FIG. 3. Each slide track unit 7 includes a movable slide track member to which the corresponding door 5 or 6 is secured for the sliding displacement therewith. Each movable slide track member also has a corresponding bracket 9 or 10 fixedly secured thereto such that the brackets 9 and 10 are bodily displaceable with the doors 5 and 6 respectively. The sliding door closure per se includes a pneumatic cylinder actuator 11 whose details do not form part of the present invention. This pneumatic cylinder acurator 11 has a piston rod whose outer end is connected to the bracket 10 to positively slide the latter and thus the door 6 bodily therewith.

According to the present invention, there is provided an intercoupling cable device which interconnects the doors 5 and 6 and produces positive concomitant or subordinated to and fro opening and closing displacement of the doors. Thus, the intercoupling cable device ensures that any movement or one door 5 or 6 is translated into a corresponding movement of the other door and also that braking of one door will result in braking of the other door. This intercoupling cable device includes a cable 12 which is wound around a pair of pulleys 13 to define an upper cable run 14 and a lower cable run 15. The upper cable run 14 is attached to the bracket 10 while the lower cable run 15 is attached to the bracket 9. An elongated side cover 16 is removably fixed outwardly of the aforedescribed door closure and hanger system to provide access to the latter.

The sliding doors and seals system of the present invention includes doors 5 and 6 which cooperatively have a combined width which exceeds the width of the passageway aperture 4, as shown in FIGS. 2 and 2*b*. Thus, the doors always overlap side wall lateral edge portions which longitudinally extend along the opposite lateral edges of the passageway aperture. These lateral edge portions are indicated by the reference numeral 17 and the associated arrows in FIGS. 2, 2*a* and 2*b*.

Each door 5 and 6 has a beval outer lateral edge portion whose free edge 19 is spaced by a thin gap from the external surface of the skin 2. Thus, the bevel edge portion 18 is adapted to plow away accumulations such as of snow against the external surface of the skin 2. Each bevel edge portion 18 forms an internal border surface 20 laterally adjacent the outer lateral edge 19 of the corresponding doors 5 and 6 and which transversely extend outward closer to the side wall of the car. As shown in FIGS. 4 and 5, the doors are also provided each with a flange 21 extending lengthwise across the width thereof and projecting on its internal side near its lower edge.

The sliding doors and seals system of the present invention and as shown in the drawings also includes a pair of three-sided inflatable air seals 22 each including a pair of opposite ends adjacent the opposite ends of the other three-sided air seal 22.

The pair of three-sided seals 22 thus extend complementarily coextensive with the full periphery of the passageway aperture 4. The opposite ends of the seals 22 are not shown but they meet at the top and at the bottom of the doors 5 and 6, substantially in alignment with the closed position defined by the inner lateral edges of the doors. The inflatable air seals 22 define a top seal portion which is fixed along the upper edge of the passageway aperture 4, a pair of lateral seal portions 23 on the opposite sides respectively of the passageway aperture, vertically extending lengthwise, and each fixed against the corresponding lateral edge portion 17 of the side wall, and a bottom seal portion which is fixed longitudinally on the lateral sill 1. Thus, each inflatable seal 22 is fixed flat against the external side of the side wall. It must be noted, that the vertically extending seal portions 23, like the lateral edge portions 17 always remain overlapped or covered by the doors, as may be see in FIGS. 2, 2*a*, 2*b* and 2*c*. This overlapping protects the inflatable seal portions 23 against direct contamination and tampering therewith. The passageway aperture is provided with a threshold member 24 which transversely project outward of the side wall substantially co-extensive with the lateral sill 1. The outer edge portion 25 of the threshold member 24 is transversely shaped to form a downwardly opening guideway for guiding rollers 26 at the bottom of the doors. The outer edge portion 25 of the threshold member 24 by its transverse overhanging of the lateral sill 1 cooperatively form with the latter a groove or longitudinal recess which extends longitudinally and laterally inward relative to the side wall. The aforementioned bottom seal portion is fixed on the sill 1 into this groove and is thus protected against wear and tear otherwise produced by exposure to contact by the feet of the passengers stepping on the threshold.

Seal strips 27, 27, and 28 of the brush type are provided on the inner side relative to the inflatable seal portions to protect the latter against contamination which could otherwise engage between the correspondng edges of the aperture 4 and the doors 5 and 6. The brush-type seal strips 27, 27 vertically extend along the lateral edges of the aperture 4, are secured against the external side of the side wall and brushingly engage against the internal side of the doors respectively. The brushtype seal strip 28 is secured at the bottom of the doors 5 and 6 to brushingly engage the top of the threshold member 24 and brush the latter longitudinally of the side wall.

A pair of weather strips 29, 29, preferably of tubular rubber construction, are fixedly secured against the outside of the lateral edge portions 27 and vertically extend laterally outward of the inflatable seal portions 23. These weather seals 29 are transversely yieldable whereby upon closing of the doors 5 and 6 the internal border surface 20 of each door abuts against the corresponding weather strip which yields to form a tight seal, as shown in FIG. 2*a*. The weather seals 29 are provided to produce the required sealing of the doors when the corresponding passenger car is parked and the seals 22 are deflated, to form a barrier against tamperng with the inflatable seal, and to prevent contamination of the inner side of the doors when the passenger car is in motion or parked with door closed.

The inflatable seals 22 are of any known type having a tubular form with a solid base portion 30 engaged in a clamping strip 31 and opposite to the movable sealing portion 32.

Each of the two aforementioned three-sided air seals is separately inflatable by any appropriate air pressure supply device or pump also required to actuate the pneumatic cylinder actuator 11, as schematically shown in FIG. 8. The two air seals are therefore connected to the air pressure supply pump 33 by two distinct dispensing circuits each embodying an appropriate flow restrictor 34 such that the failure of one seal 22 will not impair the operation of the other seal. The pump 33 is powered by a motor 35 to inflate the air seals 22 upon selective actuation of the solenoid valves 36. With the aforedescribed air pressure supply system, when one seal 22 fails, the flow restrictors 34 ensure that the other seal remains inflated. This cooperates with the aforementioned intercoupling cable 12 to hold the two doors closed upon failure, puncturing or leaking of one seal.

The doors 5 and 6 are frictionally braked against opening thereof by the pressurized inflatable seals 22, when the passenger car is in operation. If one seal 22 fails, the other seal remains pressurized and directly holds the corresponding door against opening. The intercoupling cable 12 is thus held fixed by this directly braked door, and consequently, indirectly holds the other door closed due to the positive interconnection which it provides between the doors.

What is claimed is:

1. A sliding doors and seals system comprising a side wall having a passageway aperture therethrough and a pair of side wall edge portions extending along the laterally opposite edges of said paasageway aperture, a pair of doors slidable edgewise to and fro relative to each other longitudinally and externally of said side wall, said doors cooperatively having a combined width exceeding the width of said passageway aperture and overlapping said side wall edge portions respectively in any position of said doors along said to and fro opening and closing displacement thereof, inflatable seals fixed against the external side of said wall, including at least two separate elongated sections complementarily coextensive with the full periphery of said passageway aperture, and defining a pair of lateral portions vertically extending against said lateral edge portions respectively of said side wall and remaining covered by the overlapping of said lateral edge portions by the doors respectively for any position of the doors along said to and fro opening and closing displacement thereof.

2. A sliding doors and seals system as defined in claim 1, wherein said inflatable seals include a pair of three-sided and separate seal sections each having a pair of opposite ends respectively adjoining the pair of opposite ends of the other three-sided seal section, and a fluid pressure supply system is separately connected to said separate seal sections and independently pressurizes the latter.

3. A sliding doors and seals system as defined in claim 2, further including an intercoupling device interconnecting said doors and producing positive concomitant to and fro opening and closing displacement thereof and said fluid pressure supply system separately biases said seal sections into frictional braking contact with said doors and effectively brakes both of said doors through said intercoupling device and frictional braking contact by solely one of said seal sections and upon failure of the other seal section.

4. A sliding doors and seals system as defined in claim 3, further including a threshold member for said passageway aperture, laterally projecting outward from said side wall, and cooperatively forming with the latter a longitudinal recess underlying the threshold member and laterally opened toward an internal lower edge portion of said doors, and said inflatable seal sections include a longitudinal bottom portion secured into said longitudinal recess, extending longitudinally in the latter, in inward registry with said internal lower edge portion of said doors, and sealingly abutting against the latter.

5. A sliding doors and seals system as defined in claim 4, wherein said intercoupling device comprises an endless cable including a pair of runs extending longitudinally of the side wall and said cable runs are attached to said doors respectively and arranged for positively concomitant displacement and braking of the doors.

6. A sliding doors and seals system as defined in claim 5, further including an elongated static seal means fixed against the external side of said side wall and extending longitudinally of and laterally outward with respect to said two separate longitudinal portions.

7. A sliding doors and seals system as defined in claim 6, wherein said static seal means includes one pair of lateral portions vertically extending against said lateral edge portions respectively laterally outward relative to said lateral portions of said inflatable seal, and each of said doors includes an outer lateral edge portion having an internal border surface transversely extending outward closer to said side wall and operatively abutting against one of said lateral portions of the static seal means upon closing of the doors.

8. A sliding doors and seals system as defined in claim 7, wherein said static seal means further includes another pair of lateral portions vertically extending against said lateral edge portions respectively laterally inward relative to said lateral portions of said inflatable seal.

9. A passenger vehicle comprising a side wall having a door aperture therethrough and a pair of side wall edge portions extending along the laterally opposite edges of said door aperture, a pair of doors slidable edgewise to and fro laterally relative to said door aperture and externally of said side wall, said doors cooperatively having a combined width exceeding the width of said door aperture and overlapping said side wall edge portions respectively in any position of said doors along said to and fro opening and closing displacement thereof, a pair of three-sided separate elongated inflatable seals longitudinally extending complementarily co-extensive with the full periphery of said door aperture, each of said inflatable seals having a pair of opposite ends respectively adjoining the pair of opposite ends of the other three-sided seal and including a lateral portion vertically extending against one of said lateral edge portions of said side wall, a pair of elongated static seals fixed against the external side of said side wall and including a first and a second static seal lateral portions vertically extending against each of said lateral edge portions and on the outward and inward sides respectively of the corresponding lateral portion of said inflatable seals, each of said doors including an outer lateral edge portion having an internal border surface transversely extending outward closer to said side wall and operatively abutting against the corresponding first static seal lateral portion upon closing of the doors, a threshold member provided for said door aperture, laterally projecting outward from said side wall, and cooperatively forming with the latter a longitudinal recess underlying the threshold member and laterally opened toward an internal lower edge portion of said doors, said inflatable seals cooperatively defining a longitudinal bottom portion secured onto said longtudinal recess, extending longitudinally in the latter in inward registry with said internal lower edge portion of said doors and sealingly abutting against the latter, a fluid pressure supply system separately connected to said separate inflatable seals an intercoupling cable interconnecting said doors and including a pair of runs extending longitudinally of the side wall, said cable runs being attached to said doors respectively and arranged for positively concomitant displacement and braking of the doors, and said fluid pressure supply system separately biasing said inflatable seals into frictional braking contact with said doors and effectively braking both of said doors through said intercoupling device and frictional braking contact by solely one of said infalatable seals upon failure of the other of said inflatable seal.

* * * * *